United States Patent [19]

Johansson

[11] Patent Number: 4,716,607

[45] **Date of Patent: * Jan. 5, 1988**

[54] PATIENT TRANSFER MAT

[76] Inventor: Paul J. Johansson, 1416 Grant Rd., Northbrook, Ill. 60062

[ * ] Notice: The portion of the term of this patent subsequent to Oct. 20, 2004 has been disclaimed.

[21] Appl. No.: 830,261

[22] Filed: Feb. 18, 1986

[51] Int. Cl.[4] ..... A61G 7/08

[52] U.S. Cl. ..... 5/81 R; 5/81 B; 5/82 R

[58] Field of Search ..... 5/61, 81 R, 81 B, 81 C, 5/82, 89; 128/87 R

[56] References Cited

U.S. PATENT DOCUMENTS

| | | | |
|---|---|---|---|
| 618,274 | 1/1899 | Jones . | |
| 722,456 | 3/1903 | Reeves | 5/82 R |
| 2,273,672 | 2/1942 | Van Gasselt . | |
| 2,323,500 | 7/1943 | Trigg | 5/81 R |
| 2,835,902 | 5/1958 | Fash . | |
| 3,158,875 | 12/1964 | Fletcher . | |
| 3,708,810 | 1/1973 | Merikallio . | |
| 3,813,712 | 6/1974 | Bonnin . | |
| 3,829,914 | 8/1974 | Treat . | |
| 4,012,799 | 3/1977 | Rutherford | 5/81 R |
| 4,033,000 | 7/1977 | Bonifay | 5/82 R |
| 4,067,079 | 1/1978 | Buchman . | |
| 4,124,908 | 11/1978 | Burns et al. . | |
| 4,209,011 | 6/1980 | Peck et al. | 128/87 R |
| 4,283,068 | 8/1981 | Keyser . | |
| 4,361,918 | 12/1982 | Røisaeth | 5/81 R |

*Primary Examiner*—Alexander Grosz
*Assistant Examiner*—Michael F. Trettel
*Attorney, Agent, or Firm*—Silverman, Cass, Singer & Winburn, Ltd.

[57] ABSTRACT

A patient transfer mat for aiding the moving of a patient who cannot move oneself. The mat includes a center section and a pair of wing sections integrally and hingedly attached thereto and adapted to be placed under the patient. The mat including grasping openings in each end with slots adjacent thereto for securing a strap therethrough to secure the patient to the mat. A pair of mats are placed under the patient to move the patient by sliding or lifting.

12 Claims, 4 Drawing Figures

PATIENT TRANSFER MAT

BACKGROUND OF THE INVENTION

The invention relates generally to patient moving methods and systems and more particularly to a patient transfer mat which is easy to utilize and stores compactly.

Any number of methods and systems have been utilized to shift or move a patient who is unable to move themselves. The patient can be partially lifted, slid or rolled onto a stretcher or bed by several attendants. The patient is again moved onto an operating, examining or x-ray table and then the process is repeated to place the patient back into the patient's bed. Each of these moves has the potential to aggravate the patient's injuries or even to cause new injuries.

Numerous types of systems have been utilized to assist in shifting of patient while attempting to minimize risk of injury and to facilitate ease of movement. These systems have included boards and other types of stretcher type units, which have been relatively inflexible or flexible, such as made from sheets, canvas or blankets. One system includes a plastic slab or plank placed longitudinally under the patient. Each of these systems has attempted to provide for ease in placing the patient onto the system. The plastic slab, for example, is about 508 mm by 1016 mm or larger and is made to be longitudinally slid under the patient. The slab is of a size such that the patient is substantially totally supported on the slab and can be moved or lifted on the slab by utilizing hand holds or openings in the edge of the slab. Such a slab is inconvenient to store, because of its size and it does not include any means for securing the patient on the slab.

SUMMARY OF THE INVENTION

The above and other disadvantages of prior art transfer systems are overcome in accordance with the present invention by providing an elongtaed transfer mat which is small and foldable for ease of storage and can include a strap to secure the patient to the mat. The system includes a pair of mats with one placed transversely under the patient's shoulders and another placed transversely under the patient's buttocks. The straps can be secured across the top of the patient and then a single attendant can slide the patient from a bed onto a transfer table or from table to stretcher. Further, the mats have hand holds in their outer ends which can be grasped by the attendant or can be grasped by an attendant on each side to lift the patient.

DESCRIPTION OF THE PRFERRED EMBODIMENTS

Figure 1:
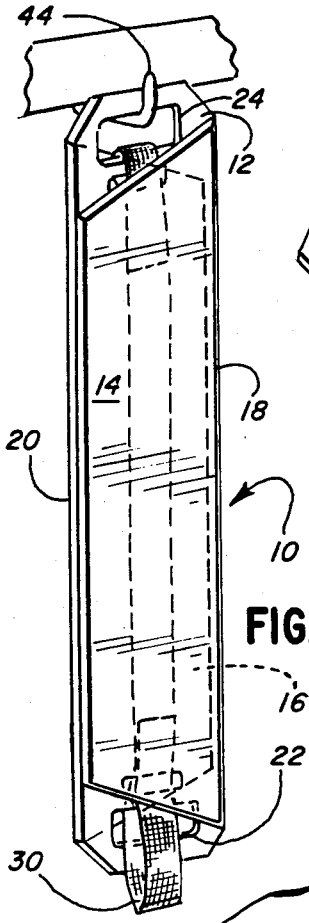
FIG. 1 is a perspective view of one mat embodiment of the present invention folded for storage.
Figure 2:
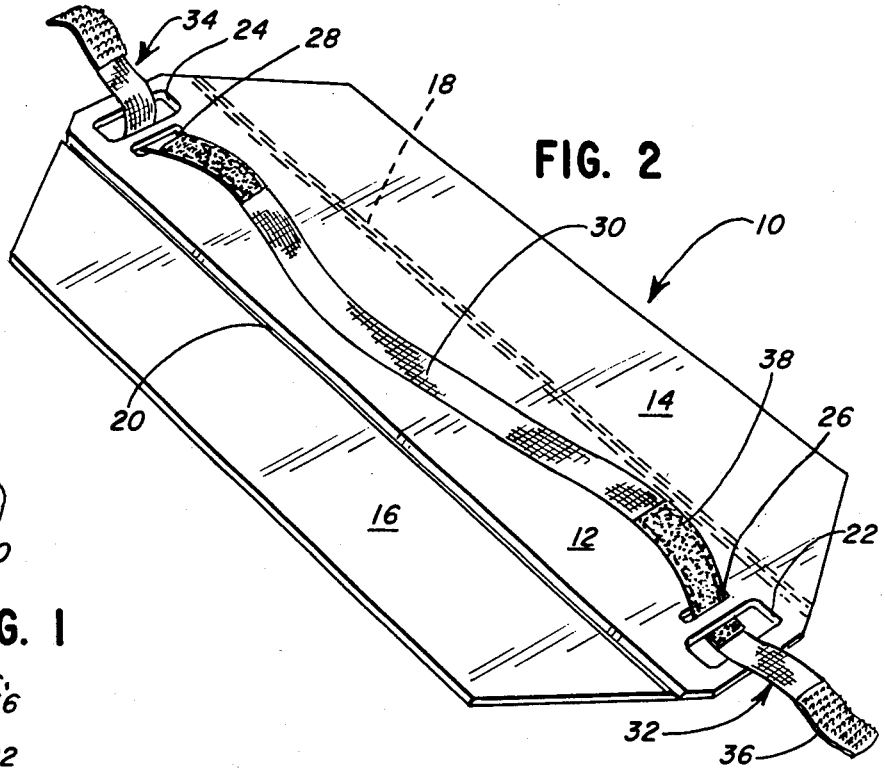
FIG. 2 is a perspective view of the embodiment of FIG. 1 unfolded for utilization.

Referring to FIGS. 1 and 2, a patient transfer mat embodying the present invention is designated generally by the reference numeral 10. The mat 10 has an elongated body portion including a center section 12 and a pair of wing sections 14 and 16. The mat 10 preferably is formed in a generally rectangular shape from a plastic material such as polyethylene, with a fairly smooth surface for ease of sliding and positioning of the mats 10 under a patient. The wings 14 and 16 are hingedly connected to the center section 12 along respective hinge regions 18 and 20. The hinge regions 18 and 20 preferably are formed integrally with the wings 14 and 16 and the center section 12, such as by a reduced or thinner thickness of material which allows the wings 14 and 16 to be folded over onto the center section 12.

The ends of the mat 10 include respective openings 22, 24 which can be grasped by an attendant to lift or move the patient. A second smaller opening or slot 26, 28 is included adjacent respective openings 22, 24, which slots 26, 28 and openings 22, 24 accomodate a strap 30 therethrough. The strap 30 includes fastening means 32, 34 at each end thereof, such as a typical loop and hook type of fastener which has a loop area 36 and a hook area 38 which adhere to each other when pressed together.

Figure 3:
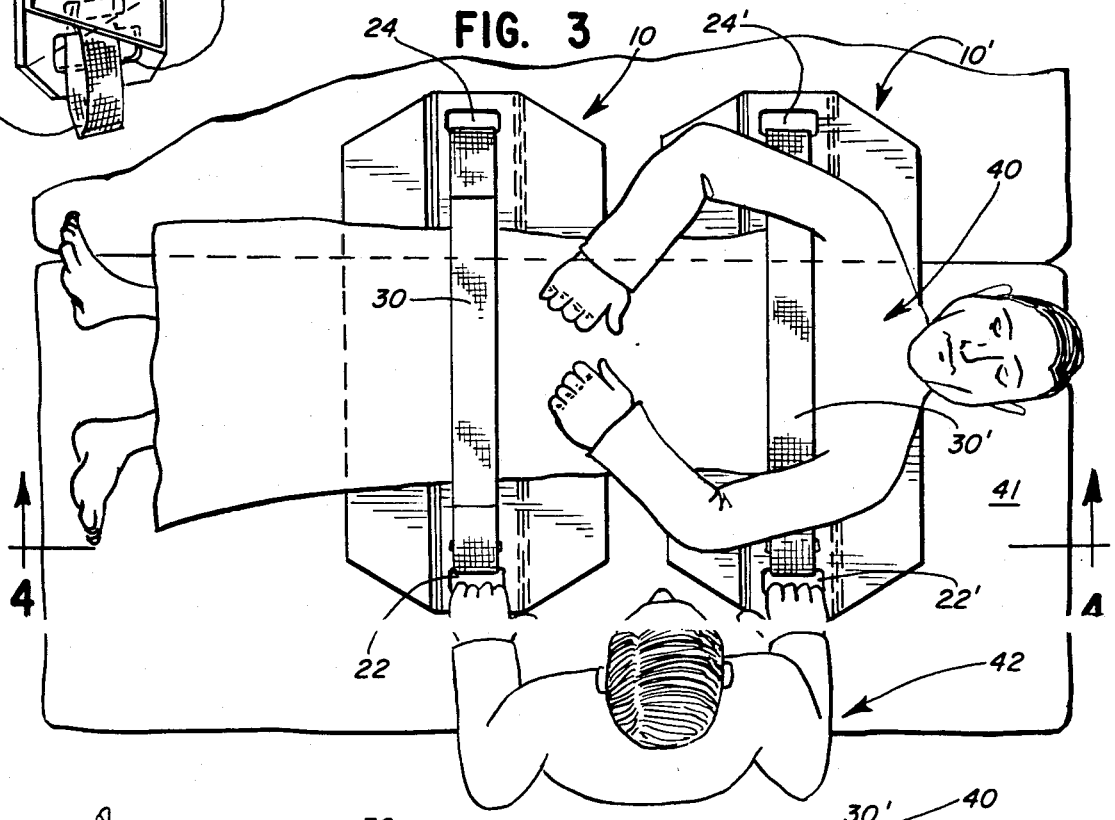
FIG. 3 is a top plan view of a pair of mats of the invention placed under a patient for movement of the patient.
Figure 4:
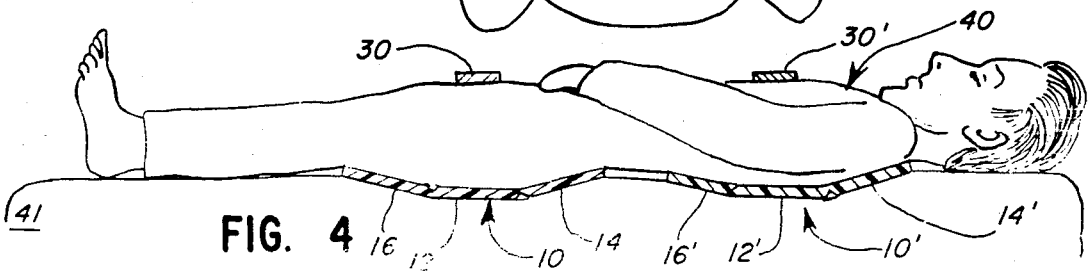
FIG. 4 is a side sectional view of the mats and patient of FIG. 3 along the line 4—4.

Referring now to FIGS. 3 and 4, the shifting or moving of a patient 40 onto or out of a bed 41 by an attendant 42 is best illustrated. A pair of mats 10 and 10' is inserted under the patient 40 and then the straps 30, 30' can be fastened over the patient 40 to secure the patient to the mats 10, 10' while the patient is moved. If required, a second attendant (not illustrated) can grasp the pair of mats 10, 10' utilizing the openings 24 and 24', while the attendant 42 grasps the openings 22, 22'. The small/relative surface area of the mats 10, 10' allow them to be easily slid or placed under the patient 40, while still providing the necessary strength to lift the patient 40, if required.

As can be seen in FIG. 4, the mat 10 is placed under the buttocks of the patient 40, while the mat 10' is placed under the upper back of the patient. The respective center and wing sections 12, 14 and 16 and 12', 14' and 16' of the mats 10 and 10' at least partially conform with the contour of the patient's body, when the patient 40 is resting on a surface, such as the bed 41. The folding wing sections 14 and 16 of the mat 10 provide a large and sufficient sliding surface for ease in moving the patient 40, while still allowing the mat 10 to have a small profile for storage. The mats 10, 10' then provide a very easy to use patient moving system, while the mats can be folded for storage, such as on a convenient hook 44 (FIG. 1). The hook 44 or other protuberance can be on a gurney or transfer bed/stretcher or in any other convenient location.

Modifications to variations of the present invention are possible in light of the above teachings. The strap 30, of course, does not have to be utilized with the mat 10. The strap 30 can be formed from any convenient material and can be eliminated if desired. The exact dimensions of the mat 10 are not critical, but one convenient size is 3 mm thick, 360 mm wide and 600 mm long. It is, therefore, to be understood that within the scope of the appended claims the invention can be practiced otherwise than as specifically claimed.

What is claimed and desired to be secured by Letters Patent of the United States is:

1. A patient transfer mat comprising:

an elongated body portion having a substantially elongated rectangular shape adapted to be placed transversely under a selected portion of the torso of a patient to facilite moving at least said torso portion of the patient, said body portion having a length substantially less than the length of the patient but greater than the width of said torso portion and having a width substantially less than said length;

said body portion being formed from a flexible but substantially rigid lightweight material and including means to at least partially conform with the contour of a portion of the patient's body, said means to conform including a center section and a wing section hingedly attached to each side of said center section, which wings bend at an angle to said center section to provide said conformation and a sufficient sliding surface for moving said patient; and openings in each end of said body portion adapted to be grasped by an attendant to move said patient.

2. The mat as defined in claim 1 including a slot spaced inside and adjacent to each said opening and means for securing said patient to said mat adapted to be secured through said slots.

3. The mat as defined in claim 2 wherein said securing means is a strap having means to releaseably secure ends of the strap to the strap spaced from said ends of the strap through said slots and opening to secure said patient to said mat.

4. The mat as defined in claim 1 wherein said body portion length is on the order of 600 mm long and said body portion width is on the order of 360 mm wide.

5. A patient transfer system, said system comprising:

a pair of transfer mats, each of said transfer mats including an elongated body portion having a substantially elongated rectangular shape adapted to be placed transversely under a selected portion of the torso of a patient to facilitate moving at least said torso portion of the patient, said body portion having a length substantially less than the length of the patient but greater than the width of said torso portion and having a width substantially less than said length;

said body portion being formed from a flexible but substantially rigid lightweight material and including means to at least partially conform with the contour of a portion of the patient's body, said means to conform including a center section and a wing section hingedly attached to each side of said center section, which wings bend at an angle to said center section to provide said conformation and a sufficient sliding surface for moving said patient; and openings in each end of said body portion adapted to be grasped by an attendant to move said patient.

6. The system as defined in claim 5 wherein said wings are formed integrally with said center section.

7. The system as defined in claim 5 including a slot spaced inside and adjacent to each said opening and means for securing said patient to said mat adapted to be secured through said slots.

8. The system as defined in claim 7 wherein said securing means is a strap having means to releaseably secure the ends of the strap to the strap spaced from said ends of the strap through said slots and opening to secure said patient to said mat.

9. The system as defined in claim 5 wherein said body portion length is on the order of 600 mm long and said body portion width is on the order of 360 mm wide.

10. A method of transferring patients substantially from one contiguous surface to another, comprising:

providing a pair of transfer mats, each of said transfer mats including an elongated body portion including means to at least partially conform with the contour of a portion of the patients body and having a substantially elongated rectangular shape adapted to be placed transversely under a patient to facilitate the moving of the patient said body portion having a length substantially less than the length of a patient, but greater than the width of a patient and a width substantially less than said length;

placing said mats under the patient by sliding one of said mats transversely under the patient's buttocks and sliding the second one of said mats under the patient's shoulders, both without lifting or turning the patient over; and openings in each end of said body portion adapted to be grasped by an attendant to move the patient and transferring said patient by sliding the patient on the two mats from a first one of the contiguous surfaces to the other, and providing said means to conform with a center section and a wing section hingedly attached to each side of said center section along said length thereof, which wings bent at an angle to said center section to provide said conformation and a sufficient sliding surface for moving the patient and conforming the mats by placing one center section substantially transverse of the shoulder of the patient.

11. The method as defined in claim 10 including integrally forming said wings with said center section and forming a slot spaced inside and adjacent to each said opening and means for securing said patient to said mat adapted to be secured through said slots and securing the patient to each of said mats prior to moving the patient.

12. The method as defined in claim 11 including forming said securing means as a strap having means to releaseably secure the ends of the strap to the strap spaced from said ends of the strap through said slots and opening to secure the patient to said mat and securing the patient to each of said mats by said straps prior to moving the patient.

* * * * *